US005303890A

United States Patent [19]

Carruth

[11] Patent Number: 5,303,890

[45] Date of Patent: Apr. 19, 1994

[54] CHIN REST APPARATUS

[76] Inventor: Thomas A. Carruth, R.R. 1, DeGraff, Minn. 56233

[21] Appl. No.: 14,740

[22] Filed: Feb. 8, 1993

[51] Int. Cl.[5] ..... B68G 5/00; B43L 15/00

[52] U.S. Cl. ..... 248/118; 248/168

[58] Field of Search ..... 248/118, 118.1, 118.3, 248/118.5, 168, 440.1, 188.9, 188.5, 918, 346, 436, 435, 434, 166

[56] References Cited

U.S. PATENT DOCUMENTS

| | | | |
|---|---|---|---|
| 833,987 | 10/1906 | Truslow | 248/439 X |
| 2,172,178 | 9/1939 | Rosenberg | 248/118 |
| 2,509,086 | 5/1950 | Eaton | 248/118 X |
| 2,630,289 | 3/1953 | Selig | 248/170 X |
| 3,155,364 | 11/1964 | Berg | 248/439 |
| 3,305,201 | 2/1967 | Thiel | 248/118 |
| 3,380,694 | 4/1968 | Branner | 248/118 |
| 3,929,309 | 12/1975 | DeVore | 248/118 |
| 4,128,317 | 12/1978 | LeCover | 248/118 X |
| 4,190,001 | 2/1980 | Cecala | 248/188.9 X |

*Primary Examiner*—Karen J. Chotkowski
*Attorney, Agent, or Firm*—leon Gilden

[57] ABSTRACT

A chin rest is arranged to include a housing having a top wall to include a pad member mounted therein. The housing includes first and second leg tubes mounted to opposed ends of the housing, that in turn include first and second respective extension legs that are provided with support pads to position the organization relative to an underlying support surface permitting an individual to rest the chin thereon during reading and other events when the individual is in the supine position.

1 Claim, 4 Drawing Sheets

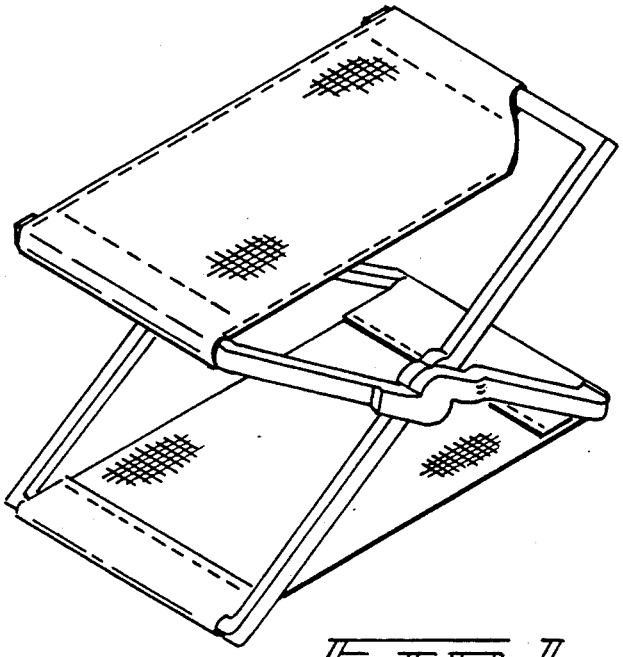
FIG 1
PRIOR ART
FIG 2
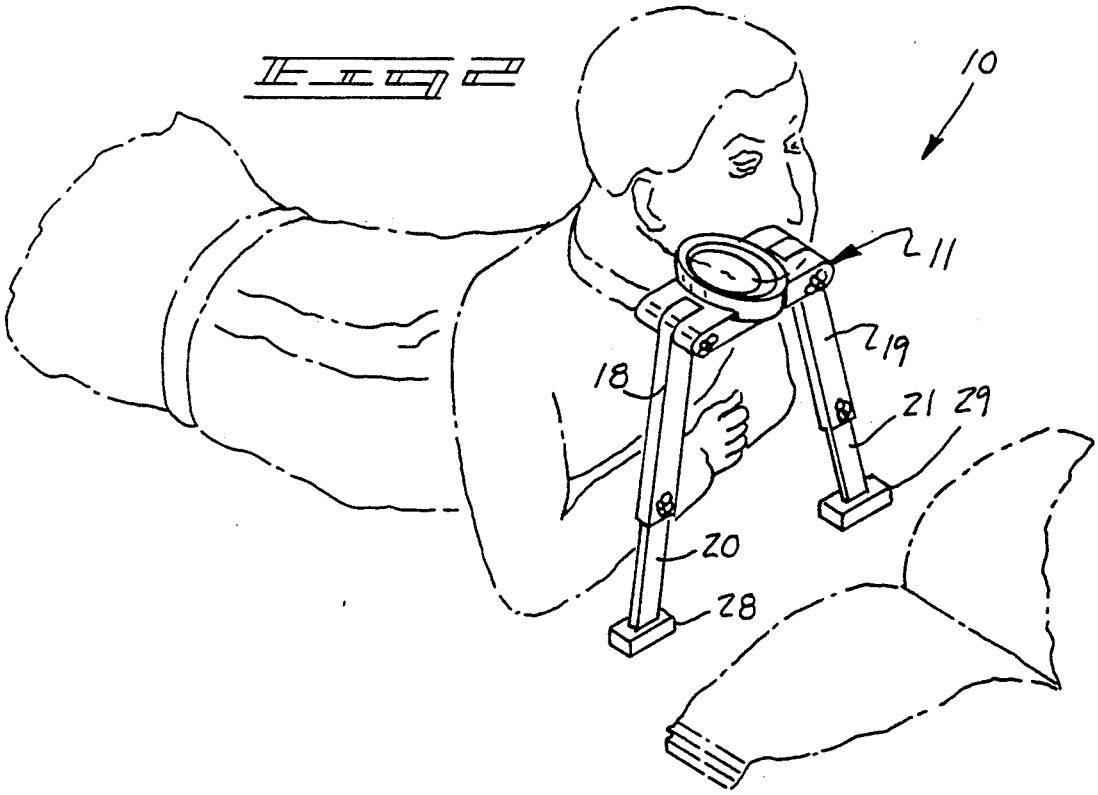

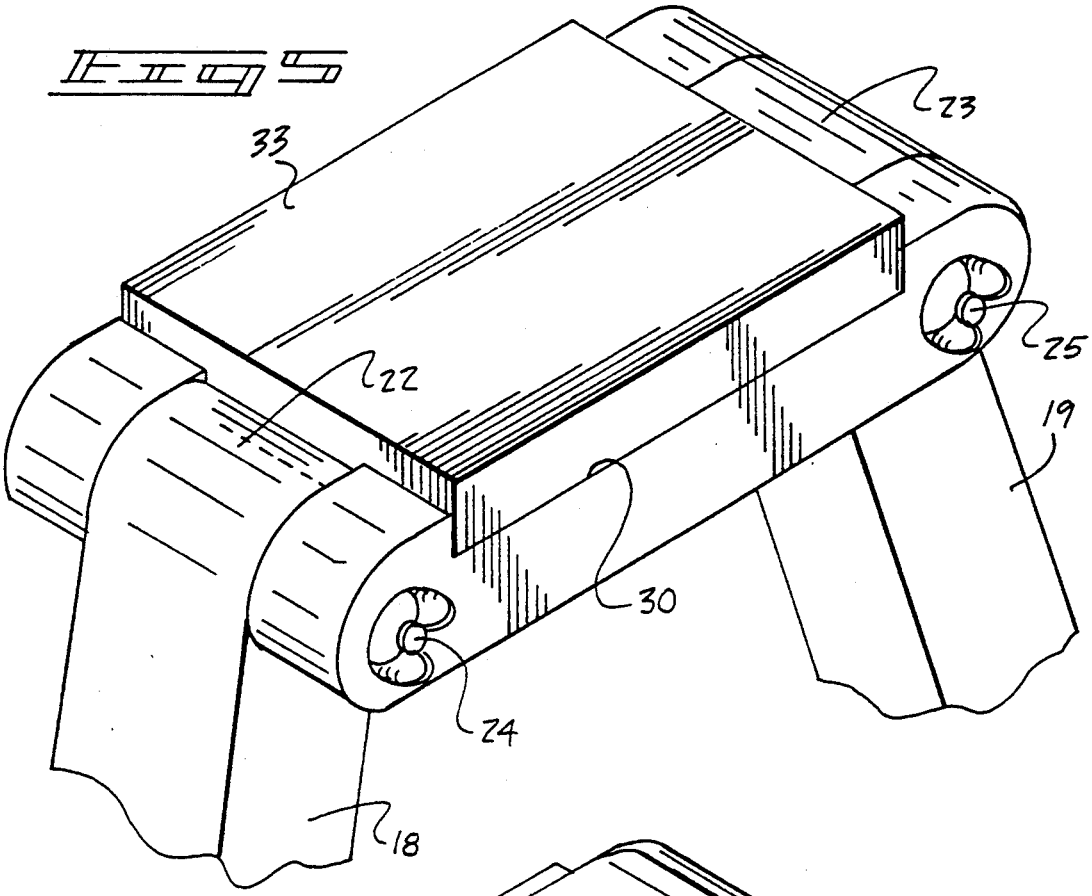
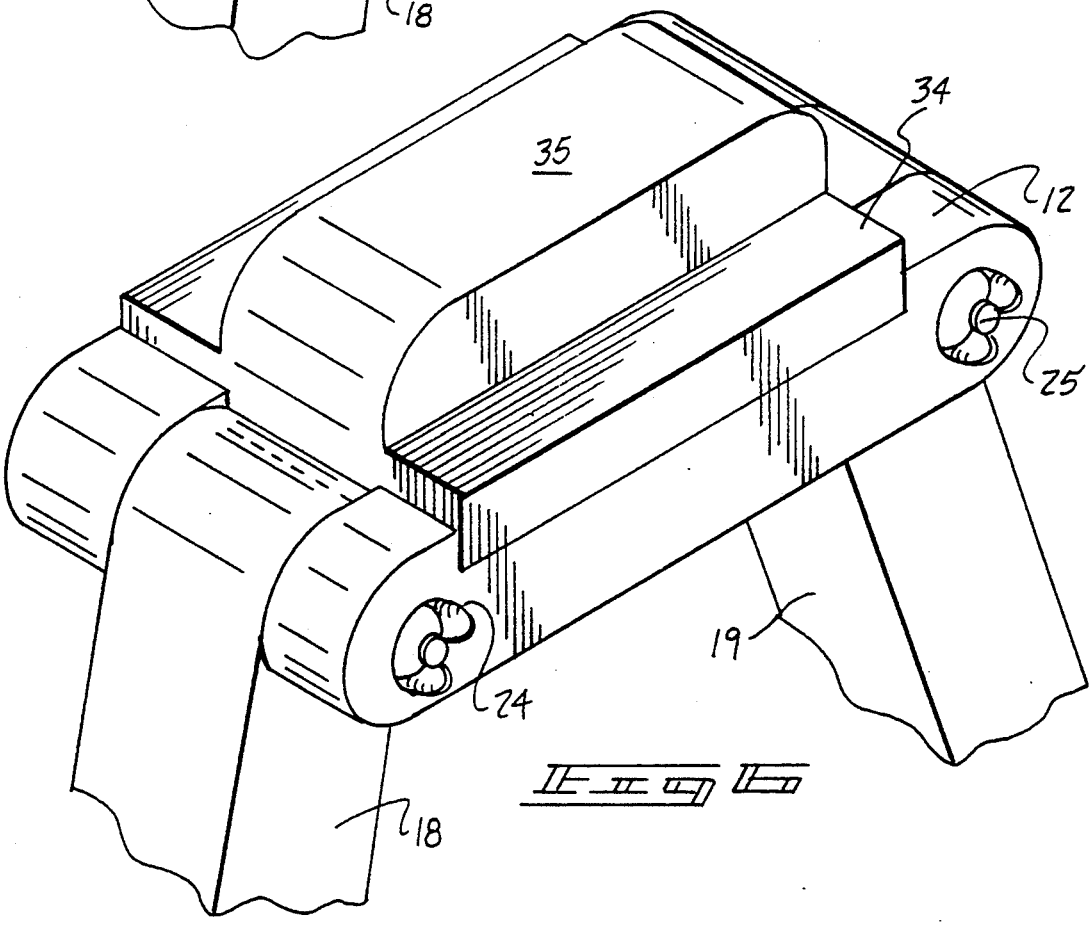
Fig 6

CHIN REST APPARATUS

BACKGROUND OF THE INVENTION

1. Field of the Invention

The field of invention relates to support apparatus, and more particularly pertains to a new and improved chin rest apparatus wherein the same is arranged to provide for a head rest in use relative to a book reading event and the like.

2. Description of the Prior Art

A head rest structure as indicated in U.S. Pat. No. 4,544,203 to Younger, wherein the organization is provided for a rest for the individual's head, wherein the instant invention provides for a concave alignment surface relative to a top surface of the base of the invention to provide for positioning an individual's chin in comfort as opposed to the head portion of the invention and in this respect, the present invention substantially fulfills this need.

SUMMARY OF THE INVENTION

In view of the foregoing disadvantages inherent in the known types of head rest apparatus now present in the prior art, the present invention provides a chin rest apparatus wherein the same is arranged to support an individual's chin when the individual is in a supine position. As such, the general purpose of the present invention, which will be described subsequently in greater detail, is to provide a new and improved chin rest apparatus which has all the advantages of the prior art support apparatus and none of tile disadvantages.

To attain this, the present invention provides a chin rest arranged to include a housing having a top wall to include a pad member mounted therein. The housing includes first and second leg tubes mounted to opposed ends of the housing, that in turn include first and second respective extension legs that are provided with support pads to position the organization relative to an underlying support surface permitting an individual to rest the chin thereon during reading and other events when the individual is in the supine position.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chin rest apparatus which has all the advantages of the prior art support apparatus and none of the disadvantages.

It is another object of the present invention to provide a new and improved chin rest apparatus which may be easily and efficiently manufactured and marketed.

It is a further object of the present invention to provide a new and improved chin rest apparatus which is of a durable and reliable construction.

An even further object of the present invention is to provide a new and improved chin rest apparatus which is susceptible of a low cost of manufacture with regard to both materials and labor, and which accordingly is then susceptible of low prices of sale to the consuming public, thereby making such chin rest apparatus economically available to the buying public.

Still yet another object of the present invention is to provide a new and improved chin rest apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art head rest structure, as indicated in U.S. Pat. No. 4,544,203.

FIG. 2 is an isometric illustration of the invention in use.

FIG. 5 is an enlarged isometric illustration of the housing structure of the invention including a replacement pad.

FIG. 6 is an isometric illustration of the invention including a further replacement pad.

DESCRIPTION OF THE PREFERRED EMBODIMENT

Figure 3:
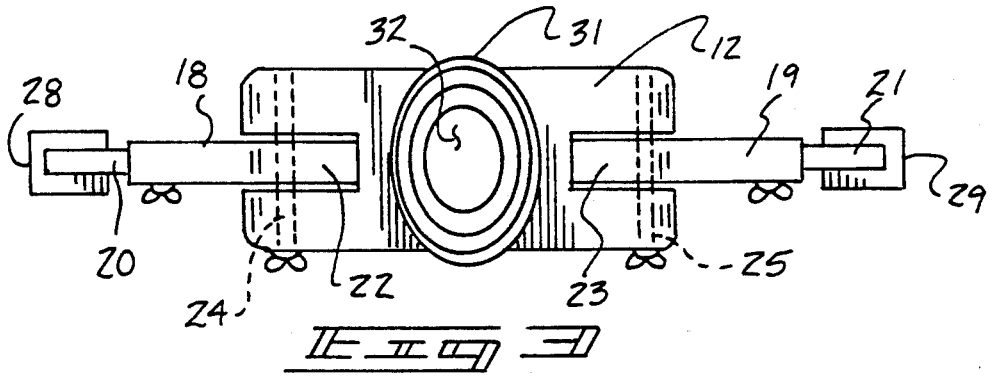
FIG. 3 is an orthographic top view of the invention.
Figure 4:
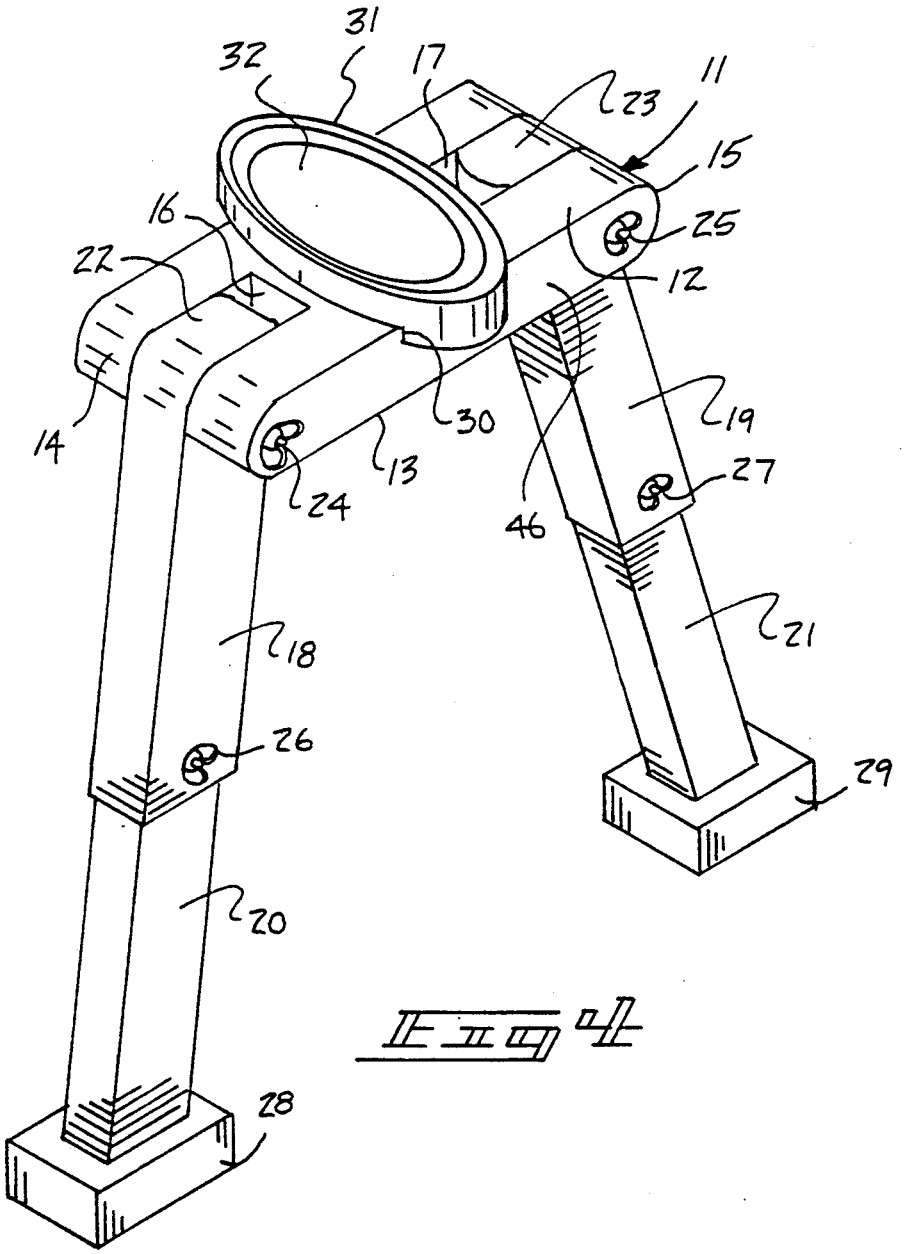
FIG. 4 is an isometric illustration of the invention.

With reference now to the drawings, and in particular to FIGS. 1 to 8 thereof, a new and improved chin rest apparatus embodying the principles and concepts of the present invention and generally designated by the reference numeral 10 will be described.

More specifically, the chin rest apparatus 10 of the instant invention essentially comprises a base housing 11, having a top wall 12 spaced from a bottom wall 13 and a first end wall 14 spaced from a second end wall 15. Respective first and second slots 16 and 17 are orthogonally directed into the first and second ends 14 and 15 to pivotally receive respective first and second leg tubes 18 and 19 about the first and second leg tube first ends 22 and 23. The first and second leg tube second ends include a first and second extension leg 20 and 21 respectively received within the first and second leg tubes 18 and 19. A first and second fastener axle 24 and 25 are orthogonally directed through the first and second respective slots 16 and 17 to pivotally mount the first and second leg tube first ends 22 and 23 respectively. The first and second fastener axles 24 and 25 are threadedly directed into the base housing forward side wall 46 to effect a drawing together of the housing on opposed sides of the first ends of the first and second leg tubes 22 and 23. The first and second leg tubes are further arranged to include third and fourth respective fasteners 26 and 27 to fixedly secure the respective first and second extension legs 20 and 21 within the respective first and second leg tubes 18 and 19. The first and second fastener axles 24 and 25 have mounted at their free distal ends first and second respective resilient foot pads 28 and 29 to provide for a non-slip mounting of the organization relative to an underlying surface. A recess 30 directed into the housing top wall 12 is arranged to receive the resilient chin pad 31 that in turn includes a concave recess 32 to receive an individual's chin thereon in a comfortable and aligned orientation to maintain the chin within the concave recess 32, in a manner as indicated in FIG. 2. The FIGS. 3 and 4 indicate the use of respective replacement and further replacement pads 33 and 34 respectively, wherein the replacement pad 33 includes a planar top surface, while the further replacement pad 34 includes a replacement pad boss 35 projecting above the replacement pad top surface to provide a further configuration for a chin support as the boss 35 is of a greater resiliency than the pad 34.

Figure 7:
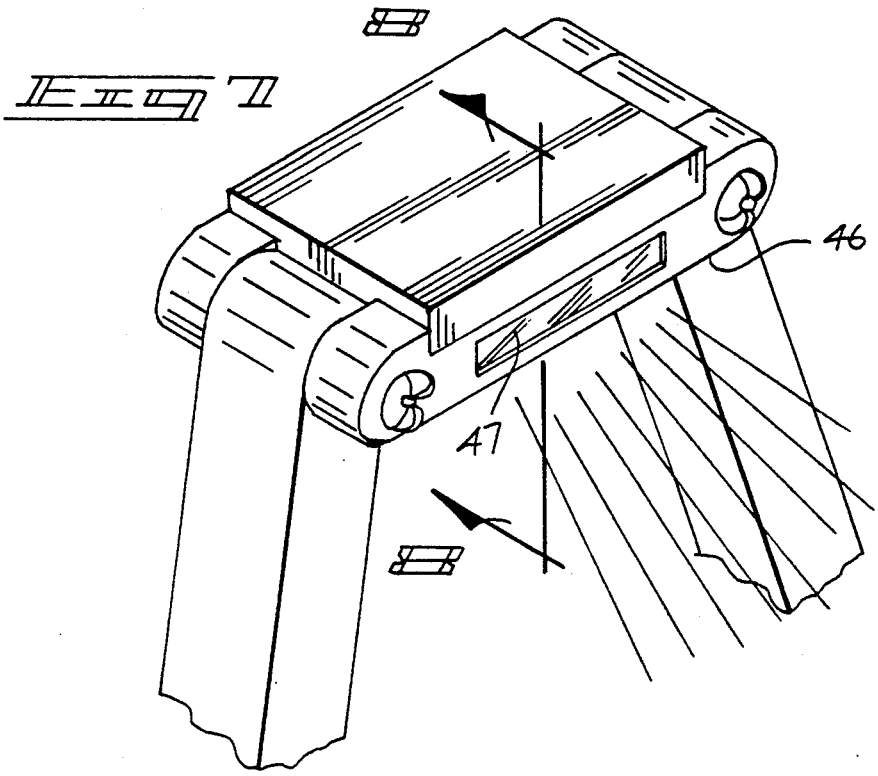
FIG. 7 is an isometric illustration of the invention employing illumination structure.
Figure 8:
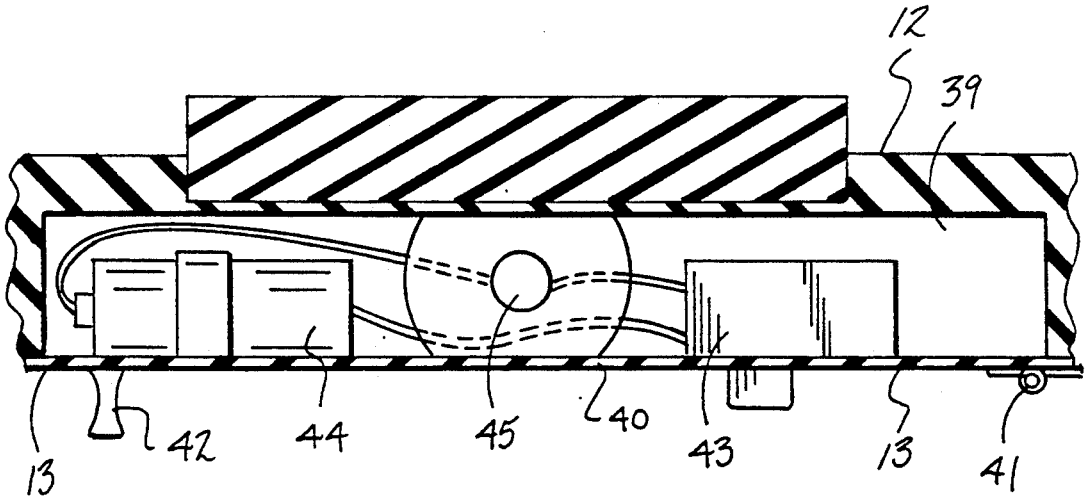
FIG. 8 is an orthographic view, taken along the lines 8—8 of FIG. 7 in the direction indicated by the arrows.

The FIGS. 7 and 8 indicate the use of a housing cavity 39 within the housing between the top and bottom walls 12 and 13 respectively, with a bottom wall door 40 pivotally mounted about a spring hinge 41 maintaining the bottom wall door 40 in coplanar alignment with the bottom wall 13. A door handle 42 permits access to the bottom wall door and to the housing cavity 39. The bottom wall door mounts a switch member 43, a battery 44, and illumination bulb 45 for ease of access and maintenance of the battery 44, the switch member 43, and the illumination bulb 45, wherein the housing forward side wall 46 includes a transparent lens 47 that is in adjacency to the illumination bulb 45 when the bottom wall 40 is in a coplanar alignment with the bottom wall 13 to thereby direct illumination from the illumination bulb 45 through the transparent lens 47 onto a book member, such as indicated in FIG. 2, to enhance ease of reading in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chin rest apparatus, comprising, a base housing, the base housing having a top wall, a bottom wall spaced from the top wall and coextensive therewith, a first end wall and a second end wall, with the first end wall and the second end wall arranged in a parallel relationship, and at least a housing forward side wall, and a first slot directed medially into the first end wall orthogonally oriented relative to the first end wall, and a second slot longitudinally aligned with the first slot orthogonally directed medially of the second end wall, and a first leg tube, having a first leg tube first end received within the first slot, and a first fastener axle orthogonally directed into the housing forward side wall and the first slot and the first leg tube first end, and a second leg tube having a second leg tube first end received within the second slot, with a second fastener axle orthogonally directed into the housing forward side wall directed orthogonally through the second slot and into the second leg tube first end, and the first leg tube includes a first leg tube second end telescopingly receiving a first extension leg therewithin, and a third fastener directed into the first leg tube to selectively secure the first extension leg therewithin, and the second leg tube having a second leg tube second end, with a second extension leg telescopingly received within the second leg tube second end, and a fourth fastener directed into the second leg tube for securement of the second extension leg relative to the second leg tube, and the first extension leg includes a first resilient foot pad at a free distal end of the first extension leg, and the second extension leg includes a second resilient foot pad mounted to a free end of the second extension leg for support to an underlying surface, and the housing top wall includes a recess between the first slot and the second slot, and a resilient chin pad directed within the recess, and the resilient chin pad including a concave recess within the chin pad for alignment and receiving an individual's chin therewithin, and wherein the chin pad and the chin pad recess are of a generally elliptical configuration and a planar replacement pad arranged for selective reception within the recess of the top wall upon removal of the chin pad, and the housing includes a housing cavity oriented between the housing top wall and the housing bottom wall, the housing bottom wall including a housing bottom wall door, having a spring hinge mounted to the bottom wall door and the bottom wall to bias the bottom wall door in a coplanar relationship relative to the bottom wall in a first position, and a door handle mounted to the bottom wall door spaced from the spring hinge for pivoting the bottom wall door in a displaced orientation relative to the bottom wall in a second position, and wherein the bottom wall door includes an on/off switch member, a battery, and an illumination bulb each in electrical communication relative to one another for providing selective illumination of the illumination bulb, and wherein the housing forward side wall includes a transparent lens, and wherein the transparent lens is in alignment with the illumination bulb when the bottom wall door is in the first position.

* * * * *